US007878835B2

(12) United States Patent
Fan

(10) Patent No.: US 7,878,835 B2
(45) Date of Patent: Feb. 1, 2011

(54) ELECTRICAL CONNECTOR

(75) Inventor: Chia-Wei Fan, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/538,882

(22) Filed: Aug. 11, 2009

(65) Prior Publication Data

US 2010/0035456 A1 Feb. 11, 2010

(30) Foreign Application Priority Data

Aug. 11, 2008 (TW) ..... 97214371

(51) Int. Cl.
*H01R 13/62* (2006.01)

(52) U.S. Cl. ..... 439/331

(58) Field of Classification Search ..... 439/331, 439/330, 333, 73, 83, 954
See application file for complete search history.

(56) References Cited

U.S. PATENT DOCUMENTS

| | | | | |
|---|---|---|---|---|
| 4,345,810 | A * | 8/1982 | Bakermans | 439/71 |
| 6,716,050 | B1 * | 4/2004 | Ma et al. | 439/331 |
| 6,780,025 | B2 * | 8/2004 | Ma et al. | 439/73 |
| 6,877,990 | B2 * | 4/2005 | Liao et al. | 439/41 |
| 7,510,403 | B2 * | 3/2009 | Ma | 439/73 |
| 2005/0014402 | A1 * | 1/2005 | Ma et al. | 439/135 |
| 2005/0106923 | A1 * | 5/2005 | Ma | 439/331 |
| 2005/0130479 | A1 * | 6/2005 | Ma | 439/342 |
| 2006/0057878 | A1 * | 3/2006 | Szu | 439/331 |
| 2006/0116016 | A1 * | 6/2006 | Szu | 439/331 |
| 2007/0054533 | A1 * | 3/2007 | Ma | 439/331 |
| 2008/0009158 | A1 * | 1/2008 | Ma et al. | 439/135 |
| 2008/0113545 | A1 * | 5/2008 | Zhang et al. | 439/345 |
| 2008/0124955 | A1 * | 5/2008 | Szu | 439/78 |
| 2008/0305654 | A1 * | 12/2008 | Fan | 439/66 |
| 2009/0004893 | A1 * | 1/2009 | Fan | 439/74 |

FOREIGN PATENT DOCUMENTS

| | | |
|---|---|---|
| TW | M244626 | 9/2004 |

* cited by examiner

*Primary Examiner*—T C Patel
*Assistant Examiner*—Harshad C Patel
(74) *Attorney, Agent, or Firm*—Andrew C. Cheng; Wei Te Chung; Ming Chieh Chang

(57) ABSTRACT

An electrical connector (100) for electrically connecting a central processing unit to a printed circuit board, including a rectangular insulative housing (40) having a plurality of receiving channels; a number of contacts received in the receiving channels; a cover (10) rotatably covering on the insulative housing so as to press the central processing unit; a lever (50) comprising an operating portion (504) and two pressing portions (503) to lock the cover; and a stiffening frame positioned under the insulative housing. Wherein said stiffening frame is formed with a first and second stiffening plates (30,31) and two stiffening beams (20), each stiffening beam has two engaging portions (212) extending longitudinally, each stiffening plate comprises a first and a second fixing plates (301,311) on two sides thereof to fix the engaging portions transversely to form a frame structure. The stiffening frame is formed by joint to avoid wasting the material of the central as the stiffening frame is formed by punching an integrated metal plate.

9 Claims, 2 Drawing Sheets

ELECTRICAL CONNECTOR

BACKGROUND OF THE INVENTION

1. Field of the Invention

The present invention generally relates to an electrical connector, and particularly to an electrical connector for connecting a central processor unit (CPU) and a printed circuit board (PCB).

2. Description of Related Patent

There are several kinds of electrical connectors for connecting a CPU and a PCB. The electrical connectors can be divided into pin grid array (PGA), ball grid array (BGA) and land grid array (LGA). A great mating force is needed to make sure the mating between the contacts of the electrical connector and the terminals of the CPU and PCB is steady.

The traditional electrical connector comprises: an insulative housing for mounting the CPU, a stiffener supporting the insulative housing, a cover covering on the insulative housing. A first end of the cover locks on the stiffener and can rotate, and a lever presses on a second end parallel to the first end to supply the mating force.

The stiffener of the traditional electrical connector are formed by punching a metal plate. Taiwan patent No. M244626 shows the stiffener is integrated, and has a central opening. Obviously, in such a structure, material would be waste as the central opening is punched.

Hence, it is desirable to have an improved electrical connector to overcome the above-mentioned disadvantages.

BRIEF SUMMARY OF THE INVENTION

Accordingly, the object of the present invention is to provide an electrical connector to save the material.

In order to achieve the above-mentioned object, An electrical connector for electrically connecting a central processing unit to a printed circuit board, including a rectangular insulative housing having a plurality of receiving channels; a number of contacts received in the receiving channels; a cover rotatable covering on the insulative housing so as to press the central processing unit; a lever comprising an operating portion and two pressing portions to lock the cover; and a stiffening frame positioned under the insulative housing. Wherein said stiffening frame is formed with a first and second stiffening plates and two stiffening beams, the stiffening beams have two engaging portions extend longitudinally, each stiffening plates comprises a first and a second fixing plates on the two sides to fix the engaging portions transversely to form frame structure. The stiffening frame is formed by joint to avoid wasting the material of the central as the stiffening frame is formed by punching an integrated metal plate.

Other objects, advantages and novel features of the invention will become more apparent from the following detailed description of the present embodiment when taken in conjunction with the accompanying drawings.

DETAILED DESCRIPTION OF THE INVENTION

Figure 1:
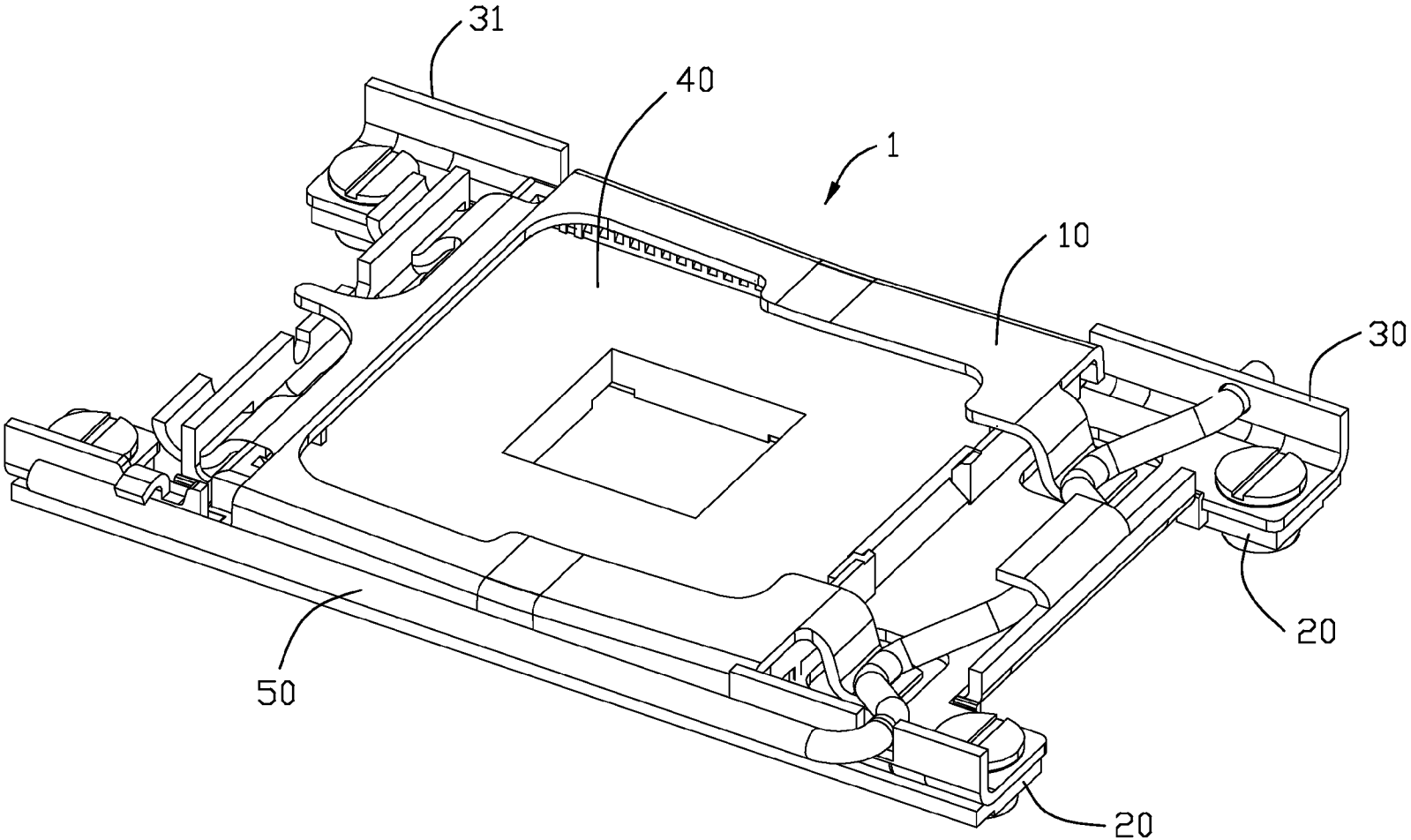
FIG. 1 is a perspective view of an electrical connector in accordance with the present invention.

Reference will now be made to the drawing figures to describe the present invention in detail.

Figure 2:
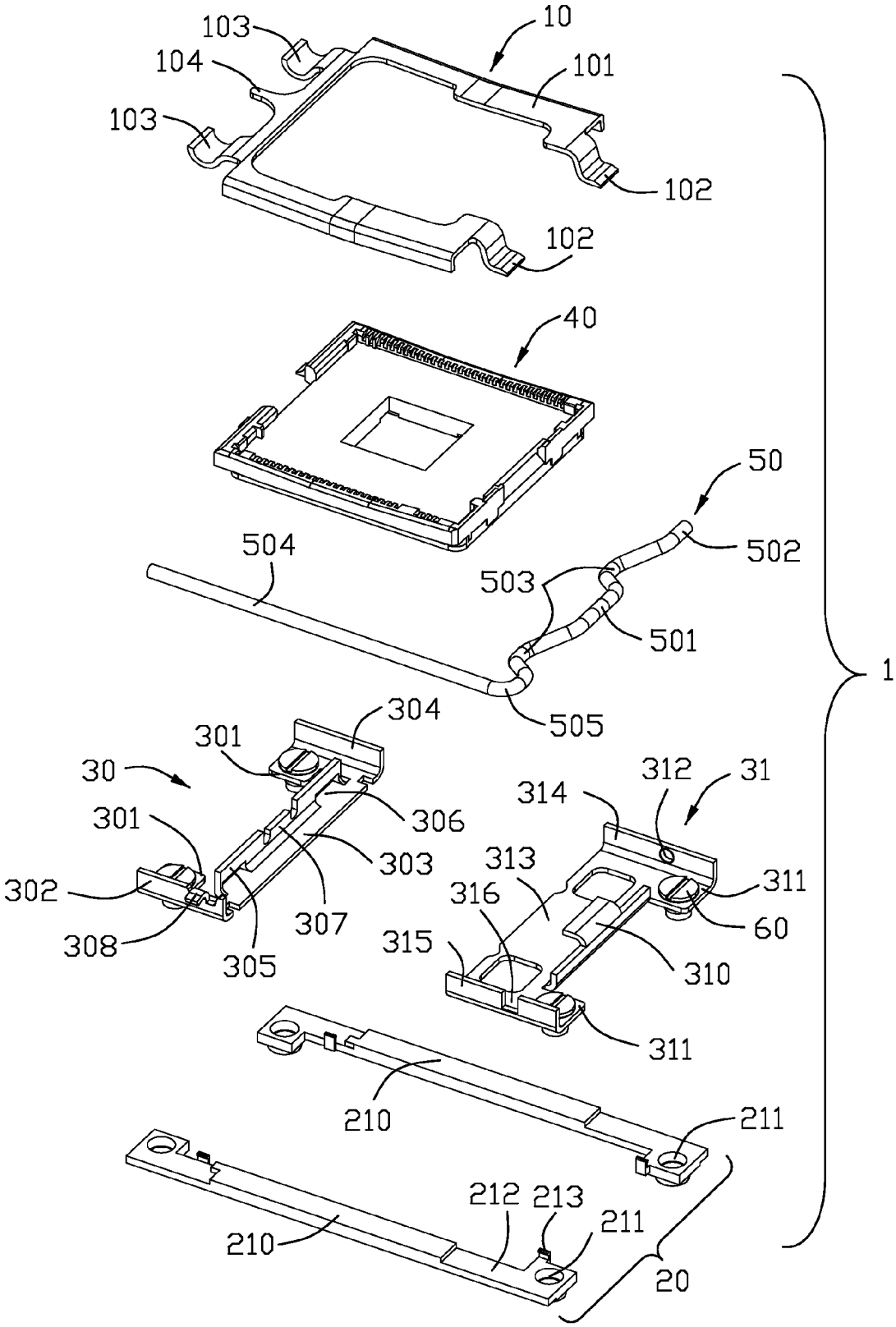
FIG. 2 is an exploded, perspective view of the electrical connector shown in FIG. 1.

Referring to FIG. 1 to FIG. 2, an electrical connector 1 in accordance with the present invention for connecting a CPU (not shown) and a PCB (not shown), comprises a rectangular insulative housing 40, a stiffening frame (not labeled) around the insulative housing 40, a cover 10 connecting to one end of the stiffening frame, said cover 10 being rotatable around the end, and a lever 50 connecting to another end of the stiffening frame and pressing the cover 10 on the insulative housing 40.

The insulative housing 40 has a plurality of receiving channels (not shown) to receive a plurality of terminals (not shown).

As FIG. 2 shows, the stiffening frame comprises a pair of strip shaped stiffening beams 20 and a pair of stiffening plates 30,31. The stiffening beams 20 extend longitudinally, and the stiffening plates 30,31 extend transversely and set on two ends of the stiffening beams separately and parallel to each other. The stiffening beams 20 and the stiffening plates 30,31 cooperate to form a frame. Each of the stiffening beams 20 has two thin engaging portions 212 on the two ends and a thick main portion 210 therebetween. Each engaging portion 212 has a fixing hole 211 and an engaging rib 213 on the inner side close to the fixing hole 211. In the preferred embodiment, the first stiffening plate 30 and the second stiffening plate 31 are of same width. The first stiffening plate 30 comprises a first base plate 303, a pair of first fixing plates 301 having a fixing opening (not labeled) formed on the two sides of the first base plate 303 and extending forward. Two side walls 302,304 extend upward from the first fixing plates 301, a front plate 305 extend upward from front side of the first base plate 303 between the side walls 302,304, and each of the front plate 305 has an engaging slot 306. An ear 308 extends outward from the side wall 302. Similar to the first stiffening plate 30, the second stiffening plate 31 has a second base plate 313, a pair of side walls 314,315, and a pair of second fixing plates 311 with a fixing opening. Different from the first stiffening plate 30, the second base plate 313 extends rearward and forms an engaging tab between the side walls 314, 315 to fix the lever 50. The side wall 314 has a hole 312, and another side wall 315 has a notch 316 correspondingly.

The cover 10 comprises a main body plate 101, a pair of securing plates 103 extending forward and a pair of engaging plates 102 extending rearward from two ends of said main body plate 101, and a tail 104 extending forward from the main body plate 101 between the securing plates 103.

The lever 50 comprises an engaging section 501 to be pressed by the engaging tab 310 of the second stiffening plate 31, two pressing portions 503 set on the two sides of the engaging section 501, a pair of locating portions 502,505, and an operating portion 504 extending from one end of the locating portion 505 perpendicularly. The pressing portions 503 press on the engaging plate 102 to press the cover 10.

The operation principle of the lever 50 is general known, so the detail will not be described. The relationship of said components will be described as follows.

The stiffening plates 30,31 are set on the engaging portions 212 of the two stiffening beams 20 so as to make the top surfaces of the first and second base plates 303,313 and the main portion 210 of the stiffening beams 20 on the same plane. The engaging ribs 213 sustain on the inner side of the fixing plates 301,311 to position the stiffening plates 30,31. The bolts 60 thread through the stiffening plates 30,31 and cooperate with the nuts on the stiffening beams 20. So a stiffening frame for mounting the insulative housing 40 is formed.

The securing plates 103 of the cover 10 rotatably mate with the engaging slots 306 of the first stiffening plate 30, and the tail 104 presses on the front plate 305 to prevent the cover from over rotating. The locating portions 502,505 of the lever 50 thread through the hole 312 and the notch 316 separately to position the engaging section 501 under the engaging tab 310, and the operate portion 504 is set under the ear 308 to press the cover 10.

Compared with the prior art, the stiffening frame in present invention is formed with separate stiffening plates 30,31 and stiffening beams 20. The stiffening beams 20 can be made of plastic or metal material, the first and second stiffening plates 30,31 can be made of metal. So material wasting of punching an integrated metal plate to form a frame structure stiffening frame can be avoided.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for electrically connecting a central processing unit to a printed circuit board, comprising:

a rectangular insulative housing having a plurality of receiving channels;

a plurality of contacts received in the receiving channels;

a cover rotatably covering on the insulative housing so as to press the central processing unit;

a lever comprising an operating portion and two pressing portions to lock the cover; and a stiffening frame positioned around the insulative housing;

wherein said stiffening frame is formed with a first and second stiffening plates and two stiffening beams, each stiffening beam has two thin engaging portions on two ends thereof extending longitudinally and a thick main portion between said engaging portions, each stiffening plate comprises a base plate and a first and a second fixing plates on two sides of the base plate, the fixing plates are fixed to the thin engaging portions, and top surfaces of the base plates and the thick main portion are on the same plane; and wherein each engaging portion of the stiffening beams has an engaging rib on an inner side thereof to sustain the stiffening plates.

2. The electrical connector as claimed in claim 1, wherein the cover is rotatably assembled on the first stiffening plate of the stiffening frame.

3. The electrical connector as claimed in claim 1, wherein the engaging portion has a fixing hole, the fixing plate has a fixing opening, and a bolt threads through the fixing hole and the fixing opening to joint the stiffening beams and stiffening plates.

4. The electrical connector as claimed in claim 1, wherein the lever rotatably assembled on the second stiffening plate, and an ear is formed on the first stiffening plate to sustain the lever.

5. An electrical connector comprising:

an insulative housing defining an upward receiving cavity in an upper face thereof, and a pair of lengthwise sides along a lengthwise direction and a pair of transverse sides along a transverse direction perpendicular to the lengthwise direction;

a plurality of contacts disposed in the housing with contacting sections upwardly extending into the receiving cavity;

a stiffener frame including a pair of stiffening beams extending along said lengthwise direction and located by and outside of said pair of lengthwise sides of the housing, and a pair of stiffening plates essentially extending along said transverse direction and located by and outside of said pair of transverse sides of the housing;

a cover pivotally mounted to one of said pair of stiffening plates; and a lever pivotally mounted to the other of said pair of stiffening plates; wherein said pair of stiffening beams and said pair of stiffening plates are alternately arranged with one another to surround said housing and assembled to one another via accessorial fastening devices respectively, and each fastening device threads through the stiffening beam and the stiffening plate, and thereby the stiffening plate is sandwiched between a portion of the fastening device and the stiffening beam.

6. The electrical connector as claimed in claim 5, wherein said stiffening plates and said stiffening beams are partially overlapped with one another in a vertical direction under condition that the stiffening beams are located under the corresponding stiffening plates, respectively.

7. The electrical connector as claimed in claim 5, wherein the stiffening beams have a plurality of engaging ribs sustaining the stiffening plates.

8. The electrical connector as claimed in claim 5, wherein the stiffening beam has a fixing hole, the stiffening plate has a fixing opening, and the fastening device comprises a bolt threading through the fixing hole and the fixing opening.

9. The electrical connector as claimed in claim 5, wherein said stiffening plates and said stiffening beams are partially overlapped with one another in said vertical direction under condition that the stiffening beams are located under the corresponding stiffening plates, respectively.

* * * * *